United States Patent [19]

Bowman et al.

[11] Patent Number: 4,920,885

[45] Date of Patent: May 1, 1990

[54] EXPLOSIVE CHARGE CONTAINING MAGAZINE FOR RAM SETTING GUN

[76] Inventors: Edward W. Bowman, 1309 Ridgeway Avenue, North Vancouver, Canada, V7L 3R9; Franciscus J. A. Storimans, 6 Ruth Court, Vandorf, Ontario, Canada, L0H 1G0

[21] Appl. No.: 297,984

[22] Filed: Jan. 17, 1989

Related U.S. Application Data

[63] Continuation-in-part of Ser. No. 138,431, Dec. 28, 1987, Pat. No. 4,819,562, which is a continuation-in-part of Ser. No. 93,302, Sep. 4, 1987, abandoned, which is a continuation-in-part of Ser. No. 243, Jan. 2, 1987, abandoned.

[51] Int. Cl.[5] ..... F42B 39/08; C06C 7/02

[52] U.S. Cl. ..... 102/281; 102/530

[58] Field of Search ..... 102/281, 530, 531, 471

[56] References Cited

U.S. PATENT DOCUMENTS

| | | | |
|---|---|---|---|
| 2,918,868 | 12/1959 | Ringdal | 102/530 |
| 3,087,428 | 4/1963 | Frech | 102/531 |
| 3,144,827 | 8/1964 | Boutwell | 102/530 |
| 3,318,245 | 5/1967 | Ferri et al. | 102/281 |
| 3,349,710 | 10/1967 | Sposimo | 102/281 |
| 3,354,571 | 11/1967 | Parker | 102/530 |
| 3,583,087 | 6/1971 | Huebner | 102/530 |
| 3,611,870 | 10/1971 | Udert | 102/530 |
| 3,625,153 | 12/1971 | Gawlick et al. | 102/281 |
| 4,036,103 | 7/1977 | Gawlick et al. | 102/281 |
| 4,056,062 | 11/1977 | Walser et al. | 102/281 |
| 4,098,169 | 7/1978 | Gawlick et al. | 89/35.01 |
| 4,294,173 | 10/1981 | Ferri | 102/281 |
| 4,406,079 | 9/1983 | Buechel et al. | 102/281 |
| 4,565,114 | 1/1986 | Burdick et al. | 102/531 |

FOREIGN PATENT DOCUMENTS 2097899 10/1982 United Kingdom .

*Primary Examiner*—David H. Brown
*Attorney, Agent, or Firm*—John R. Uren

[57] ABSTRACT

A propellant containing device for a power actuated tool used to drive fasteners into concrete and the like. A cartridge member has an inner substantially cylindrical recess. The recess has an inner area and is filled with propellant. A cap closure member is used to seal the cartridge member and holds a detonator charge. An annular skirt formed integral with the cartridge member is located so as to act as one half of the anvil when the detonator charge is compressed between the annular skirt and the cap closure member using rim-fire techniques. The cap closure member and the cartridge member are made from a suitable plastic material.

14 Claims, 3 Drawing Sheets

EXPLOSIVE CHARGE CONTAINING MAGAZINE FOR RAM SETTING GUN

INTRODUCTION

1. CROSS REFERENCE TO RELATED APPLICATIONS

This application is a continuation-in-part of my application Ser. No. 138,431 filed Dec. 28, 1987, now U.S. Pat. No. 4,819,562 which is a continuation-in-part of my application Ser. No. 093,302, filed Sept. 4, 1987, now abandoned, which is a continuation-in-part of my application Ser. No. 000,243, filed Jan. 2, 1987, now abandoned, the disclosures of which are incorporated herein by reference.

2. FIELD OF THE INVENTION

The present invention relates to a plastic cased propellant magazine for use in a powder driven bolt setting gun and, in particular, to a magazine comprising a plurality of substantially equally spaced cartridge members, each cartridge member being operable to receive gunpowder and a cap formed so as to be mounted to the cartridge member, the cap and the cartridge member being formed from plastic material.

BACKGROUND OF THE INVENTION

The widespread use of poured concrete in buildings has many benefits over buildings made from other materials, such as wood. These benefits include a reduction in fire risk, an increased speed and ease of production and low noise transmission between floors. A variety of devices have been developed to assist in the attachment of fittings and equipment, particularly electrical and plumbing fittings, to such buildings. Although it is relatively easy to drill holes and to insert anchors in concrete, it is time consuming relative to simply driving a nail or a staple in wood.

This problem has led to the development and marketing of products to the construction industry known as RAM SET (Trademark) guns, power hammers or HILTI (Trademark) guns. The concept common to all these devices is the use of an explosive or propellant charge which is detonated inside a hand-held gun, the propellant charge being used to propel a metal object such as a threaded bolt into a hard surface such as a concrete wall. These guns are extensively used in the construction of concrete buildings such that plumbing pipes and electrical cables may be hung on fastening devices fixed in concrete. The propellants can also be used in cattle stun guns and starter pistols.

Manufacturers currently manufacture the cartridges or containers for the explosive charges by deep-drawing brass into a shape resembling a small caliber bullet except that there is no slug at the top of the bullet. At least one manufacturer inserts the cartridges into a plastic strip so that the gun can be used in a semi-automatic fashion rather than a single shot mode. Typically, these devices include drive engaging means, such as notches, formed on the strip so that the strip can be advanced by the gun and properly aligned with the firing hammer or detonating pin in the gun to subsequently explode the respective charge.

One problem with the prior art apparatus is its relatively high expense. Typically and as described, the magazine component is a two component system comprising a plastic carrier having a series of holes and non-ferrous brass cartridges that fit the holes. Brass is expensive and the necessary deep-drawing and annealing of brass to form the required shape for the cartridge is also unduly complex.

Caseless charges have been designed to avoid the expense of deep drawing non-ferrous metals. Disadvantages have been experienced with such caseless charges, however, because of ignition difficulties. One such difficulty is that ignition of adjacent propellant charges has occurred due to a lack of a combustion sealing mechanism between the cartridges. This is, of course, dangerous and unsafe. A caseless charge magazine which reduces or eliminates this danger is disclosed in U.S. Pat. No. 4,406,079 which describes a strip of caseless charges wherein the propellant charge is displaced into the gun for ignition. The system, however, is incompatable with the more widely used types of guns and it is an inconvenient requirement to position each propellant in its own chamber prior to ignition. A further problem with such caseless charges has been that methods to initiate detonation generally utilise initiation techniques which are not as reliable as rim fire techniques. Rim fire techniques are preferable since they are in far wider use.

In the aforementioned U.S. application Ser. No. 138,431, there was disclosed apparatus used to reduce the costs associated with brass cartridges and to allow the manufacture of the magazine to proceed more efficiently. To that end, a cartridge member made from a plastic material and having a cylindrical-like cavity therein to hold the propellant was disclosed. The cartridge member had an integrally formed annular skirt and a circular opening around the periphery of the annular skirt, the opening being adapted to receive and hold a percussion cap closure which was easier to manufacture and utilised less material than many cartridges of the prior art. One of the percussion cap closures, however, continued to be made from brass. In addition, a plastic closure member was also disclosed rather than a closure member made from brass.

While these apparatuses reduced the need for a non-ferrous material and allowed easier manufacture of cartridges, there was still the need for metal to allow detonation of the primer. The requirement for metal makes the manufacturing process unnecessarily expensive and complex.

The following references disclose subject matter which is pertinent to the technology set forth in the present specification.

U.S. Pat. No. 2,918,868, Ringdal, issued Dec. 29, 1959 discloses an invention relating to a cartridge comprising a base having a tubular extension and a case which consists of relatively elastic flexible synthetic resin material, such as polyethylene or polyvinylchloride. The attachment of the case and cartridge base to each other is secured by means of a bead on the one member in engagement with a corresponding groove in the other member.

U.S. Pat. No. 3,318,245, Ferri et al., issued May 9, 1967 discloses strip ammunition for toy guns wherein a plurality of discrete explosive charqes are contained in container means. Stalk means interconnects each container means. Stop means are formed on the stalk means for engagement by an advancing means of a toy gun. In this way the strip can be advanced by the space between each container means each time the gun is fired.

U.S. Pat. No. 4,294,173, Ferri, issued Oct. 13, 1981, discloses ammunition for a toy-weapon comprising an injection molded support having seats for explosive charges. The charges are sealed within the seats by a separate cover for each seat. The covers are injection moulded simultaneously into the seats of the support.

U.S. Pat. No. 3,349,710, Sposimo, issued Oct. 31, 1967 discloses a strip carrier for explosive socket caps for toy guns. The explosive is encased in wells which are capped by a series of caps strung together in series.

U.S. Pat. No. 3,583,087, Huebner, issued June, 1971 discloses a certain design of magazine.

U.S. Pat. No. 3,611,870, Udert, issued October, 1971, discloses a cartridge magazine construction in which the cartridge is placed in a narrow band having a plurality of tubular projections formed therein. Each projection holds a single cartridge.

Gawlick et al. have been active in this area. U.S. Pat. No. 3,625,153, issued December, 1971, discloses a plurality of plastic propellant cases formed in series on a base.

U.S. Pat. No. 4,036,103, Gawlick et al., issued July 19, 1977, disclose a magazine apparatus for accommodating propellant charges including a flat coilable metal strip having a plurality of holes extending transversely therethrough for accommodating the insertion of cartridges. Cartridge holding collars are formed at each of the holes by bulging or plastically deforming the strip in the region of these holes so as to form a clamping seal spaced from the plane of the strip for clampingly engaging cartridges held at the strip. Various preferred embodiments include various cross-sectional configurations of the holding collars. The method of making the magazine apparatus includes forming the collars by a multiple-step bulging process wherein the last bulging step is formed by the cartridges as they are inserted into position on the strip.

U.S. Pat. No. 4,098,169, Gawlick et al., issued July 4, 1978, discloses an ammunition belt apparatus for accommodating propellant cartridges includinq a flexible, coilable belt strip, a plurality of holes extending transversely through the strip and spaced from one another in the longitudinal direction of the strip. Clamping means are associated with each of the holes for clamping a cartridge to the strip with portions of the cartridge extending through one of the holes. Parts of the clamping means are formed separately from the strip and the cartridge. In preferred embodiments, the clamping means includes a tubular casing formed separately from the strip for each of the holes. The tubular casing press-fittinqly engages a respective cartridge for holding the cartridge in position on the strip with the casing. A cartridge rim clamps the strip therebetween.

U.S. Pat. No. 4,056,063, Walser et al., issued Nov. 1, 1977, discloses a magazine for use in an explosive powder driven bolt setting gun. A cartridge holding space for a caseless charge is formed by the combination of a cartridge recess in a band-shaped magazine body and a torus-shaped body superimposed on the magazine body to form an extension of the recess. Various configurations of the cartridge holding space and the exterior of the torus-shaped body can be used. A variety of openings can be provided through the cartridge holding space to prevent destruction of the magazine parts when the caseless charge is ignited.

U.S. Pat. No. 4,406,079, Buechel, issued Sept. 27, 1983, discloses a magazine for caseless propellant charges, such as those used in a fastening element setting device. The magazine consists of an elongated strip-like member. Cut-outs are provided in the strip-like member and a caseless charge holder is secured in each cut-out by webs. A caseless charge and the holder are displaced out of a cut-out when a sufficient force is directed against the holder to separate the webs from the strip-like member.

U.S. Pat. No. 4,565,114, Burdick et al., issued Jan. 21, 1986, discloses a cartridge magazine for holding cartridges for feeding to the barrel of an explosion driven fastener setting tool. The magazine comprises an elongated flat flexible strip or band preferably made of an inexpensive material such as plastic. The strip includes a plurality of stepped projections defining cartridge holding recesses arranged at equally spaced locations along the strip and lateral recesses for advancement. Each cartridge holding recess is defined by a stepped projection extending upwardly from the strip which on its exterior is stepped inwardly in a direction toward the tip of the cartridge. The angular taper of each of the outside walls of this portion on the cartridge magazine is slightly less than one cone angle of the cartridge chamber of a gun barrel with which it is to be employed. In this way there is more than one sealinq point between the projections and the inner wall of the cartridge chamber.

SUMMARY OF THE INVENTION

The present invention provides an explosive or propellant containing device which is used in association with a gun to drive an attachment member into a structure, particularly a concrete structure. The device is intended to minimize or eliminate the use of drawn non-ferrous metal such as brass and is less expensive to manufacture than prior art devices.

According to one aspect of the invention, there is disclosed a propellant containing device for a power actuated tool comprising cartridge member means having an inner substantially cylindrical recess, said recess having an outer area and an inner open area, cap means operable to close said inner open area of said cartridge member means, annular retaining arm means on the periphery of one of said cap or cartridge member means, annular arm recess means complementary to said annular retaining arm means in the other of said cap or cartridge member means for allowing entry into and holding said retaining arm means, annular skirt means inside the diameter of said annular retaining arm means, said annular skirt means being adjacent to and in operable contact with a detonating charge means, said detonating charge means being located between said annular skirt means and said cap means.

According to a further aspect of the invention, there is disclosed a method of manufacturing a propellant containing device for a power actuated tool comprising inserting propellant in a substantially cylindrical recess of a plastic cartridge member, inserting detonating charge means in one of said cartridge member or a plastic cap means while allowing access of said detonating charge means to said propellant and assembling said base means to said cartridge member such that said detonating charge means is located between and in operative contact with said cartridge member and cap means.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT s

Figure 1:
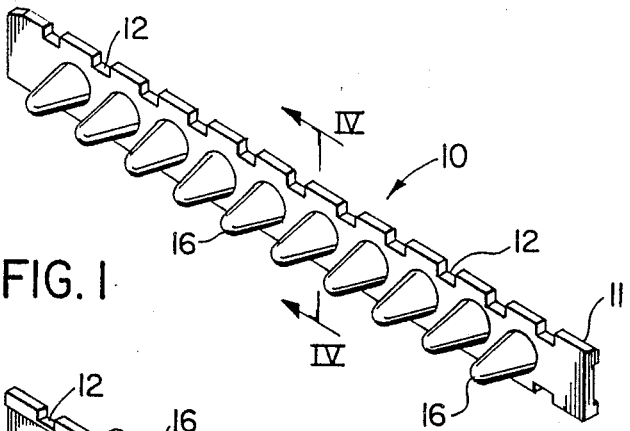
FIG. 1 is a front diagrammatic isometric view of a magazine utilising a plurality of propellant containing devices according to the invention.
Figure 2:
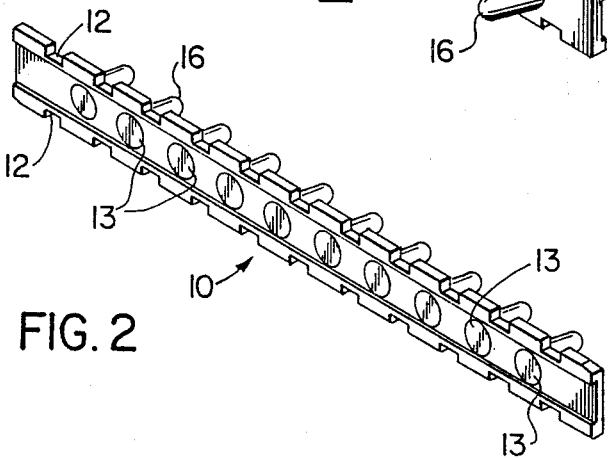
FIG. 2 is a rear diagrammatic isometric view of the magazine of FIG. 1.
Figure 10:
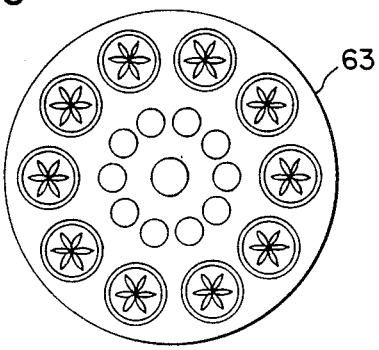
FIG. 10 is a plan view of a circular magazine according to the invention which is used in certain types of guns.

Referring now to the drawings, FIGS. 1 and 2 illustrate front and rear isometric views of the propellant containing device generally illustrated at 10. An elongate base or magazine 11 which is commonly used in powder actuated tools or power hammers to drive an attachment member into a structure contains a plurality of rounded cartridge members 16 A circular magazine 63 might also be used with the cartridge members 16 as seen in FIG. 10.

The magazine 11 has a series of drive notches or slots 14 which allow the magazine 11 to be driven by the drive of a powder actuated tool or power hammer and indexed with relation to the detonation pin of the gun or power hammer. The rounded cartridge members 16 are integral with the magazine 11 and are formed from a suitable plastic material such as a heat extrudable polymer selected from polyethylene or polyvinylchloride which is moisture impervious.

Reference is now made to FIG. 2 which is a rearward view of the magazine 11 with the plurality of rounded cartridge member 16 integrally formed therewith. A plurality of cap members 13 are inserted in the open ends of each rounded cartridge member 16 as will be described in greater detail hereafter.

Figure 3:
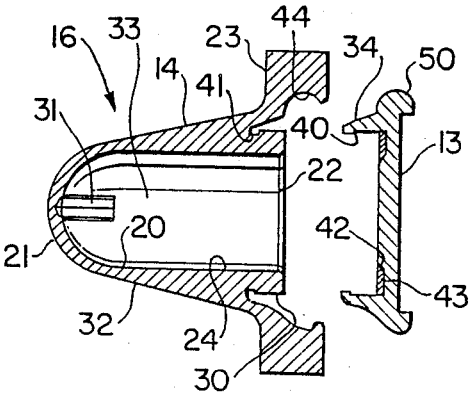
FIG. 3 is an exploded view of a propellant containing device according to the invention.

The propellant containing device 10 is also best illustrated in more detail in FIG. 3. It comprises a cartridge member 14 and a cap closure member 13. The cartridge member housing 14 has an inner substantially cylindrical recess 20 and an outer area 21 which is closed. The recess 20 has an and an inner area 22 which is open and adjacent the base 23 of the cartridge member 16.

Cartridge member 16 further includes an annular skirt 24 which runs about the periphery of the cartridge member 16 and is defined on the inside by the cylindrical recess 20 and on the outside by an annular arm recess 30 which likewise runs around the periphery of the cartridge member 16 and which will be further described hereafter.

A crease 31 is formed on the inside of the outer area 21. The crease 31 can be formed in the shape of an "x" or similar configuration showing lines of weakness and assists the detonated charge contained in the cylindrical recess 20 to burst through the top of the cartridge member 14 and into the barrel of the powder actuated tool or power hammer.

The cartridge member 16 has a conical shape and the wall 32 between the exterior of the cartridge member 16 and the cylindrical recess 20 has a tapered thickness with the thicker end adjacent the inner area 22 and the thinner area being located adjacent the outer area 21 of the cartridge member housing 14. The wall 32 may be increased or decreased in thickness so that the interior cylinder recess 20 can be increased or decreased in volume to hold various volumes of gunpowder depending on the power required in the particular operation.

The propellant, namely gunpowder 33, either in the form of powder or solid pellet is inserted into and contained within cylindrical recess 20. It acts to provide the force to the fastener in the powder actuated tool or power hammer as will be described hereafter. The interior wall of the cylindrical recess 20 may have one or more grooves if faster burning of the propellant 33 is desired.

The cap closure member 13 is likewise made from the same plastic material as is the cartridge member 16 although, of course, a different plastic material may also be used. The cap closure member 13 has an annular arm 34 extending outwardly from the closure member 13 and about its periphery. The annular arm 34 is adapted to fit within and be held by the annular arm recess 30 in the cartridge member 16. A projection 40 is formed on the inner side of the annular arm 34 and is adapted to be held by a similar female receptacle 41 in the cartridge member 16.

A detonating charge recess 42 is provided in the cap closure member 13 opposite from the annular skirt 24 and a detonating charge 43 is placed in the recess 42. As clearly seen in FIG. 3, the charge recess 42 together with the detonating charge 43 has access to the propellant 33 in the cylindrical recess 20 of the cartridge member 16 so that ignition of the propellant 33 is possible following detonation of the primer or detonating charge 43.

A lip 44 is formed on the bottom circumference of the cartridge member 16 and a complementary rounded circumference 50 is formed on the bottom of the cap closure member 13. When the cap closure member 13 is inserted into the cartridge member 16, it is adapted to be tightly held both by the annular arm 34 and the annular arm recess 30 and by the rounded circumference 50 which is held solidly by the lip 44 on the cartridge member 16.

OPERATION

In operation and with reference again to the drawings, the magazine 11 is molded together with the cartridge members 16 using techniques as are known in the injection molding art. A propellant in the form of a powder or a pre-formed pellet of gunpowder 33 is inserted into the inner cylindrical recess 20 of the cartridge member 16.

The cap closure member 13 with its detonating charge recess 42 is likewise molded from suitable plastic material using techniques as are known in the art and the primer or detonating charge 43 is placed in the detonating charge recess 42 in a position where the firing pin of the gun impacts upon the cap closure member 13.

The annular arm 34 of the cap closure member 13 is then inserted into the annular arm recess 30 of the cartridge member 16 until the projection 40 on the annular arm 34 is received and firmly held by the female receptacle 41 and the rounded circumference 50 of the closure member 13 is firmly held by the lip 44 of the cartridge member housing 14.

Figure 4:
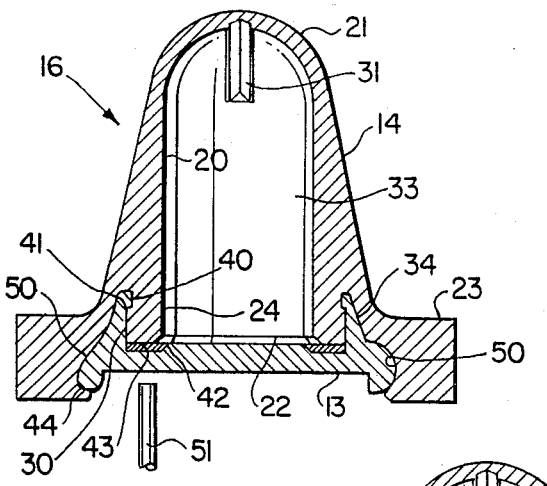
FIG. 4 is an assembled sectional view of the propellant containing device of FIG. 3 taken along IV—IV of FIG. 1.

The cartridge member 16 may, as viewed in FIG. 4, be used independently as is a single shell in a standard bullet or, preferably, it is used with a linear magazine 11 as illustrated in FIGS. 1 and 2 or a round magazine 63 as seen in FIG. 10. If it is used with the linear magazine 11, the magazine 11 will be inserted in the particular powder actuated tool or power hammer to be used and the indexing of the magazine 11 by use of the drive notches 12 will bring, in sequence, each of the cartridge members 16 to its indexed position adjacent the firing pin 51 (FIG. 4) such that the firing pin 51 will compress the detonating charge or primer 43 between the cap closure member 13 and the annular skirt 24 of the cartridge member 16. The compression will be such that the required anvil effect is obtained and the detonating charge 43 will be detonated. This detonation will cause ignition of the propellant 33 which will then burst through the crease 31, the crease 31 being the weakest point of the cartridge member housing 14.

As detonation of the primer 43 and ignition of the propellant 33 occurs, a tremendous increase of pressure occurs in the cylindrical recess 20. This pressure will force the annular skirt 24 outwardly and against the annular arm 34 which will then be, in turn, forced outwardly against the remaining width of the wall of the cartridge member 16 adjacent its base 23. The annular arm 34, the annular skirt 24 and, indeed, the propellant containing device 10 in its entirety is designed to withstand such pressure so that no escape of gases occurs from the propellant containing device 10 except through the crease 31 in the outer area 21 of the cartridge member housing 14 which is, of course, within the barrel of the gun or power hammer.

The pressure can be used to drive either a high velocity or low velocity (piston-actuated) tool. The pressure will propel the piston member into the attachment member (not shown) outwardly and into the concrete wall intended to be pierced by the attachment member.

Figure 9:
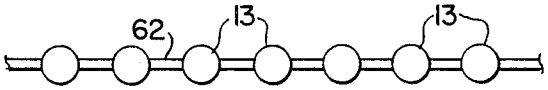
FIG. 9 is a view of a plurality of closure members according to the invention in a manufacturing and assembly operation.

The assembly of the propellant containing device 10 may be enhanced by attaching a plurality of cap closure members 13 together using tabs or runners 62 in the form illustrated in FIG. 9. The position of each cap closure member 13 is designed to be such that a series of cap closure members 13 may simultaneously be inserted into respective cartridge members 16 on the magazine 11 after insertion of the propellant or gunpowder 33 and, thus, a completed assembly can be obtained more expediently than individually assembling each propellant containing device 10.

Figure 5:
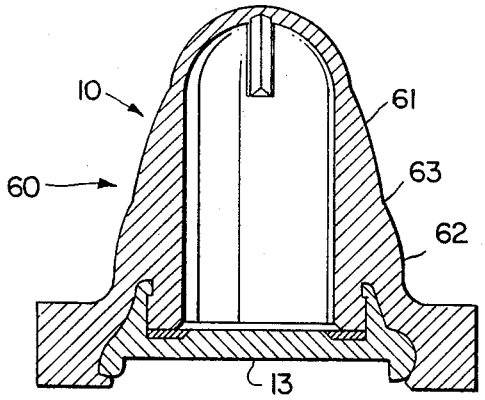
FIG. 5 is a view similar to FIG. 4 but illustrating a stepped exterior on the cartridge member.
Figure 6:
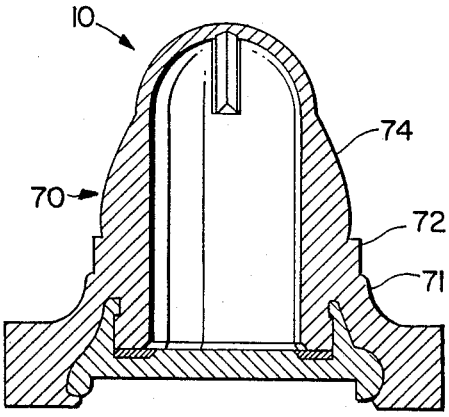
FIG. 6 is a view similar to FIG. 4 but illustrating a variation of the stepped exterior illustrated in FIG. 5.
Figure 7:
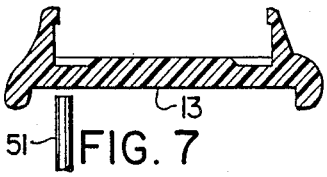
FIG. 7 is a sectional view of the closure cap member portion of the propellant containing device of FIG. 3.
Figure 8:
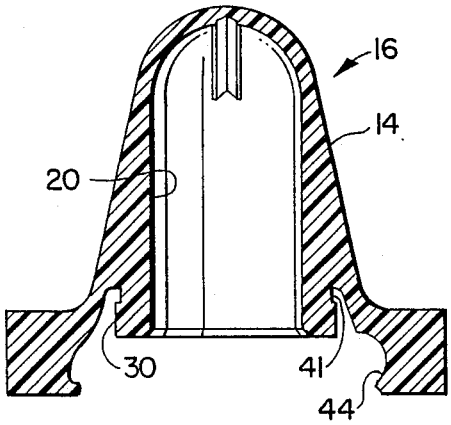
FIG. 8 is a sectional view of the cartridge member portion of the propellant containing device of FIG. 3.

Variations of the propellant containing device 10 are further illustrated in FIGS. 5 and 6. In each of these embodiments, it is intended to reduce or eliminate the disadvantage of reduced sealing capabilities experienced with a pure conical shape where the shape of the exterior surface of the cartridge chamber 16 is straight and has the problems set out in U.S. Pat. No. 4,565,114. In each of the embodiments shown in FIGS. 5 and 6, the exterior surface of the cartridge members 60, 70 has at least one raised portion around the circumference of the exterior surface and a peripheral channel likewise extending around the exterior surface. The embodiment illustrated in FIG. 5, for example, has two arcuate sealing shoulders 61, 62. The first shoulder 61 and the second shoulder 62 define between them a shock absorption cavity 63 which serves as a high pressure gas pressure absorption space. Cavity 63 assists the sealing action both before and during firing and assists in ejection of the cartridge member 60 from the cartridge chamber of the gun after detonation.

The embodiment illustrated in FIG. 6 has a first arcuate shoulder 74 and a second arcuate shoulder 71, which are separated by a right angle shoulder 71, to define two gas pressure absorption cavities. This is in contrast to the single cavity 63 illustrated in the exterior surface of the cartridge member 60 of FIG. 5. In certain instances, it may be found by experimentation that it is preferable to have two or more gas pressure cavities to assist in sealing action with a shock absorption cavity between the sealing points.

Many further modifications other than those described and illustrated will readily occur to those skilled in the art to which the invention relates and the specific embodiments previously set forth should be considered as illustrative of the invention only and not as limiting its scope as defined in accordance with the accompanying claims.

We claim:

1. A propellant containing device for a powder actuated tool comprising cartridge member means having an inner substantially cylindrical recess, said recess having an outer area and an inner open area, cap means operable to close said inner open area of said cartridge member means, annular retaining arm means on the periphery of one of said cap or cartridge member means, annular arm recess means complementary to said annular retaining arm means in the other of said cap or cartridge member means for allowing entry into and holding said retaining arm means, annular skirt means inside the diameter of said annular retaining arm means, said annular skirt means being adjacent to and in operable contact with a detonating charge means, said detonating charge means being located between said annular skirt means and said cap means.

2. A propellant containing device as in claim 1 wherein said cartridge member means and said cap means are made from a suitable plastic material.

3. A propellant containing device as in claim 2 wherein said plastic material is a heat extrudable polymer selected from polyethylene or polyvinylchloride.

4. A propellant containing device as in claim 3 wherein said heat extrudable polymer is moisture impervious.

5. A propellant containing device as in claim 4 wherein said annular retaining arm means extend from said cap means and said annular arm recess means is located within said cartridge member means.

6. A propellant containing device as in claim 5 wherein said cap means further includes detonating charge recess means, said detonating charge recess means holding said detonating charge means.

7. A propellant containing device as in claim 6 wherein said annular arm recess means holds said retaining arm means by a projection mounted on said retaining arm means and an inwardly directed female receptacle means in said recess means to receive said projection.

8. A propellant containing device as in claim 7 wherein the thickness of said cartridge member means adjacent said cap means is greater than the thickness of said cartridge member means remote from said cap means.

9. A propellant containing device as in claim 8 wherein said cartridge member has an exterior surface, said exterior surface having at least one raised portion extending around the periphery of said cartridge member.

10. A propellant containing device comprising a cartridge member having a cartridge member housing, said housing having an outer area and an inner substantially cylindrical recess, said recess having an inner open area, a cap member operable to close said inner open area of said cartridge member, an annular retaining arm on the periphery of said cap member, an annular arm recess complementary to said annular retaining arm in said cartridge member for allowing entry into and holding said retaining arm, an annular skirt between said inner open area and said annular retaining arm, a detonating charge annular recess in said cap member located opposite to said annular skirt and a detonating charge in said detonating charge annular recess.

11. A propellant containing device as in claim 10 wherein said cartridge member housing has a closed outer area, said closed outer area having a crease formed on the inside of said cartridge member housing opposite from said closed outer area.

12. A propellant containing device as in claim 10 wherein said cartridge member and said cap member are made from a suitable plastic material.

13. A propellant containing device as in claim 12 wherein said suitable plastic material is a heat extrudable polymer selected from polyethylene or polyvinylchloride.

14. A propellant containing device as in claim 13 wherein said heat extrudable polymer is moisture impervious.

* * * * *